US010266368B2

(12) United States Patent
Turse et al.

(10) Patent No.: US 10,266,368 B2
(45) Date of Patent: Apr. 23, 2019

(54) WEDGE AND MANDREL ASSEMBLY FOR SLIT-TUBE LONGERONS

(71) Applicant: Composite Technology Development, Inc., Lafayette, CO (US)

(72) Inventors: Dana Turse, Broomfield, CO (US); Adam Gray, Broomfield, CO (US); Doug Richardson, Westminster, CO (US); Robert Taylor, Superior, CO (US)

(73) Assignee: COMPOSITE TECHNOLOGY DEVELOPMENT, INC., Lafayette, CO (US)

( * ) Notice: Subject to any disclaimer, the term of this patent is extended or adjusted under 35 U.S.C. 154(b) by 914 days.

(21) Appl. No.: 14/733,506

(22) Filed: Jun. 8, 2015

(65) Prior Publication Data

US 2015/0368903 A1 Dec. 24, 2015

Related U.S. Application Data

(60) Provisional application No. 62/009,212, filed on Jun. 7, 2014.

(51) Int. Cl.
*E04H 12/02* (2006.01)
*B65H 75/44* (2006.01)

(52) U.S. Cl.
CPC ... *B65H 75/4402* (2013.01); *B65H 2701/371* (2013.01); *E04H 12/02* (2013.01)

(58) Field of Classification Search
CPC ... B64G 1/443; B29C 67/0014; B29C 1/0608; F16H 19/064; B65H 75/34; B65H 2701/371; B65H 75/4402; E04H 12/02
USPC ..... 72/466.2
See application file for complete search history.

(56) References Cited

U.S. PATENT DOCUMENTS 6,217,975 B1 * 4/2001 Daton-Lovett ..... B29C 61/0608 156/161
6,256,938 B1 * 7/2001 Daton-Lovett ..... F16H 19/064 138/119
6,602,574 B1 * 8/2003 Daton-Lovett ..... B65H 75/34 264/257
8,863,369 B2 * 10/2014 Taylor ..... B29C 67/0014 29/447
9,611,056 B1 * 4/2017 Spence ..... B64G 1/443

* cited by examiner

*Primary Examiner* — David B Jones

(57) ABSTRACT

An assembly that includes a wedge and mandrel that share an axis of rotation and can be rotated independently or simultaneously to stow or deploy slit-tube longerons. A wedge is crescent shaped, with a height that increases along an outer perimeter as the arc of the crescent is traversed from a first end to a second end. The changing height of the wedge allows a slit-tube longeron to be flattened for stowage or can be disengaged to allow the tube to curl up for deployment.

16 Claims, 10 Drawing Sheets

Figure 2
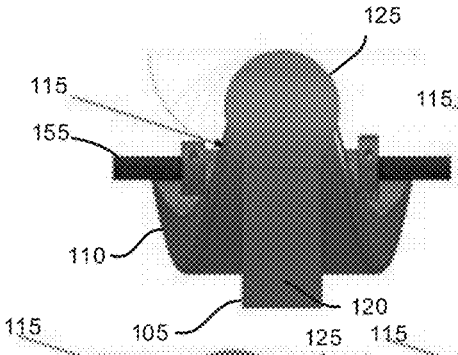
Figure 3
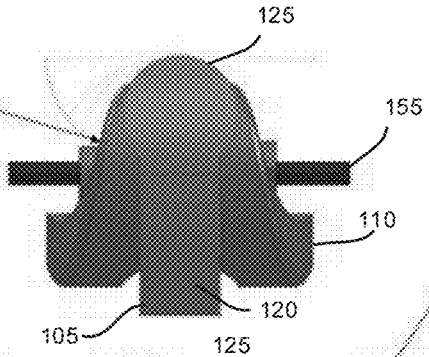
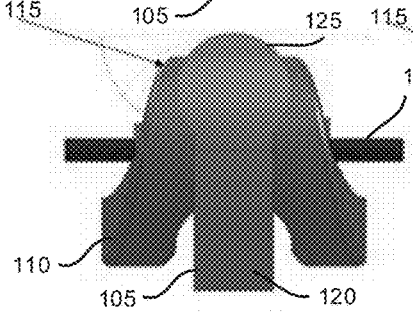
Figure 4
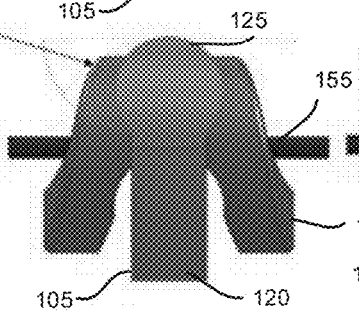
Figure 5
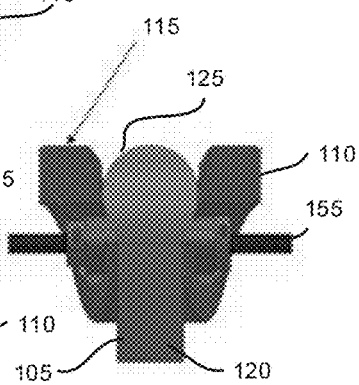
Figure 6

WEDGE AND MANDREL ASSEMBLY FOR SLIT-TUBE LONGERONS

BACKGROUND

Slit-tube longerons can be utilized in energy applications, such as solar arrays, and defense and aerospace systems requiring strong, lightweight, and easily deployable supports, among many other applications.

BRIEF SUMMARY

Embodiments of the invention include an assembly that includes a wedge and mandrel that share an axis of rotation and can be rotated independently or simultaneously to stow or deploy slit-tube longerons. The wedge is crescent shaped, with a height that increases along an outer perimeter as the arc of the crescent is traversed from a first end to a second end. The changing height of the wedge allows a slit-tube longeron to be flattened for stowage or can be disengaged to allow the tube to curl up for deployment.

The terms "invention," "the invention," "this invention" and "the present invention" used in this patent are intended to refer broadly to all of the subject matter of this patent and the patent claims below. Statements containing these terms should not be understood to limit the subject matter described or to limit the meaning or scope of the patent claims below. Embodiments of the invention covered by this patent are defined by the claims below, not this summary. This summary is a high-level overview of various aspects of the invention and introduces some of the concepts that are further described in the Detailed Description section below. This summary is not intended to identify key or essential features of the claimed subject matter, nor is it intended to be used in isolation to determine the scope of the claimed subject matter. The subject matter should be understood by reference to the entire specification of this patent, all drawings and each claim.

BRIEF DESCRIPTION OF THE DRAWINGS

Illustrative embodiments of the present invention are described in detail below with reference to the following drawing figures:

FIG. 2 is a rear view of the assembly of FIG. 1 in a deployed state according to some embodiments of the invention.

FIG. 3 is a rear view of the assembly of FIG. 1 with the wedge slightly rotated according to some embodiments of the invention.

FIG. 4 is a rear view of the assembly of FIG. 1 with the wedge slightly rotated according to some embodiments of the invention.

FIG. 5 is a rear view of the assembly of FIG. 1 with the wedge significantly rotated according to some embodiments of the invention.

FIG. 6 is a rear view of the assembly of FIG. 1 with the wedge fully rotated according to some embodiments of the invention.

DETAILED DESCRIPTION

Figure 1:
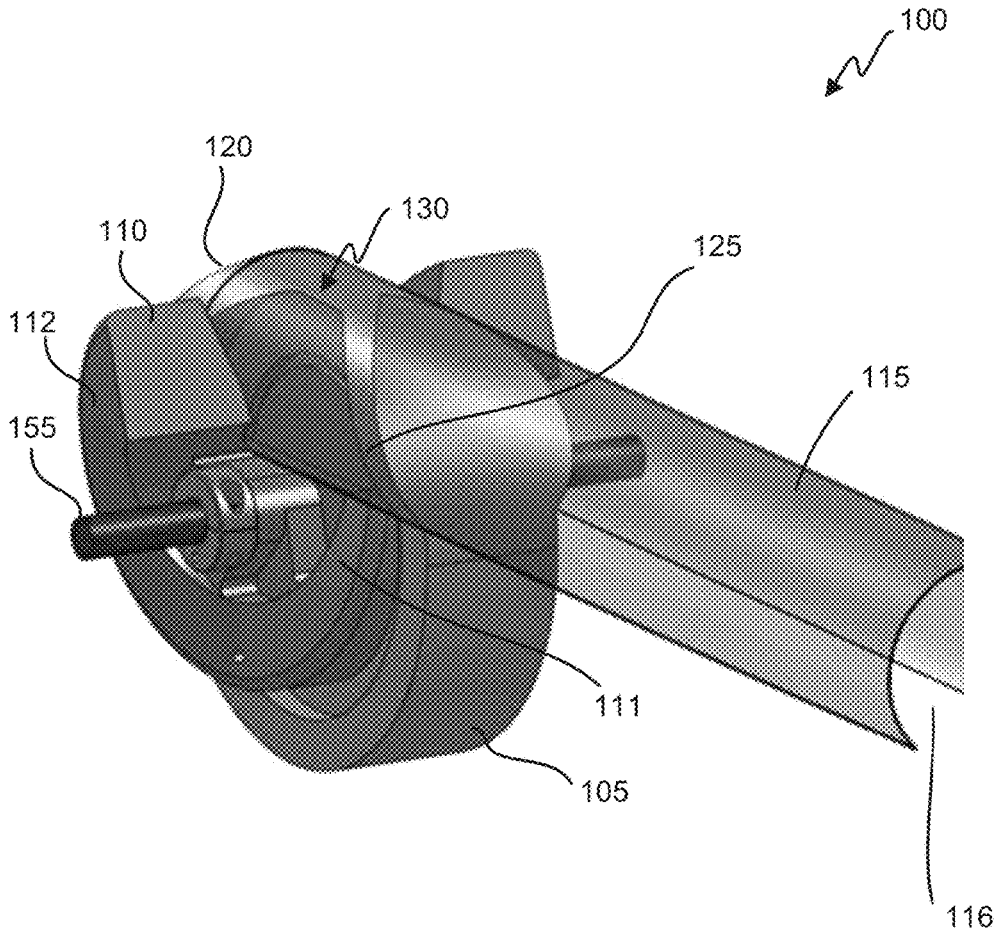
FIG. 1 is an isometric view of a mandrel and wedge assembly according to some embodiments of the invention.

The subject matter of embodiments of the present invention is described here with specificity to meet statutory requirements, but this description is not necessarily intended to limit the scope of the claims. The claimed subject matter may be embodied in other ways, may include different elements or steps, and may be used in conjunction with other existing or future technologies. This description should not be interpreted as implying any particular order or arrangement among or between various steps or elements except when the order of individual steps or arrangement of elements is explicitly described. Like numerals within the drawings and mentioned within this document represent substantially identical structural elements. Each example is provided by way of explanation, and not as a limitation. For instance, features illustrated or described as part of one embodiment may be used on another embodiment to yield a further embodiment. Thus, it is intended that this disclosure includes modifications and variations.

Slit-tube longeron systems often present an unstable transition region after and during deployment near the mandrel where the slit-tube longeron was deployed. The transition region may limit a system's application potential by weakening the resulting structure. In practice, the transition region can extend from a few inches to several feet, requiring supporting hardware, which can add volume, cost, and/or complexity to the system.

Embodiments of the invention are directed toward a wedge and mandrel assembly utilizing independent rotation. The assembly can have a deployment process including a first step of curling a slit-tube longeron to provide structural support and a second step of unrolling a rolled up slit-tube longeron. The assembly can be used, for example, in a stowage process that includes flattening the slit-tube longeron using the wedge and reeling in the slit-tube longeron into a rolled position using the mandrel. The use of a specially shaped wedge, having an axial height that increases as the perimeter is traversed, allows the assembly to eliminate weakened transition periods by allowing the portion of the slit-tube longeron not in contact with the wedge and mandrel assembly to remain curled in a deployed state. The curled of the slit-tube longeron in a deployed state can provide the slit-tube longeron with structural strength. This eliminates the necessity for additional support equipment and can help reduce cost, complexity, and/or deployment times. The assembly allows for a slit-tube longeron to undergo multiple stow and deploy sequences, making this a robust and cost-efficient deployment device for a slit-tube longeron.

A slit-tube longeron may include any elongated tubular material. A slit-tube longeron may have a cross-sectional profile comprising all or a portion of a circle, ellipse, curved, or polygonal shape. Moreover, a slit-tube longeron can include a slit along the longitudinal length of the slit-tube longeron. The slit can include a straight slit, curved, and/or jagged slit along the longitudinal length of the slit-tube longeron. In some embodiments a slit can allow portions of the longeron to overlap or have a wide slit; the latter comprising a fractional tube longeron such that a cross section of the longeron comprises an open shape.

In some embodiments, a slit-tube longeron can have two states. A first state can include a rolled or stowed state. A second state can include an expanded or deployed state. In the stowed state the slit-tube longeron can flatten laterally and be rolled longitudinally. In the deployed state the slit-tube longeron can be extended longitudinally and rolled or curved laterally. The slit-tube longeron can be stable in both the stowed state and deployed state.

In some embodiments, a slit-tube longeron can have a single rest state. That is, the slit-tube longeron can have a single stable state. For example, the deployed state can be stable and the rolled state unstable. Thus, in the rolled state the slit-tube longeron must be constrained in order to maintain the slit-tube longeron in the rolled state. Once the constraints are released, the slit-tube longeron will extend into the deployed state. A slit-tube longeron with such functionality can be utilized in various devices. For example, such a slit-tube longeron can be included in a de-orbiting satellite device in which the longeron is deployed to extend an atmospheric drag sail. An embodiment of a de-orbiting satellite device is described in further detail below.

In some embodiments, a slit-tube longeron can have multiple rest states. Such slit-tube longerons can be in a rest state at some point between the rolled and extended shape. Moreover, various other types of resting states can exist.

Slit-tube longerons can be useful in spacecraft applications. Spacecraft are limited in power, stowed volume, and mass available to meet requirements. These parameters are traded against each other as well as overall cost in spacecraft design. More efficient solar array packaging and mass would allow spacecraft to have more power on orbit or the same power for less mass and stowed volume. Additional power could be used, for example, to increase services for RF communications, provide power for electric propulsion, or increase the science capability of exploratory spacecraft. Similarly, additional stowed volume could be used, for example, for additional antennas for RF communications or larger science instruments. Also, a simpler solar array design could be fabricated and tested for a lower cost. Because of the extremely constrained nature of spacecraft design and because nearly all spacecraft require solar arrays for power, solar arrays with greater mass and volume efficiency could be used to increase the capability or decrease the cost of a spacecraft for any mission.

FIG. 1 is an isometric view of a mandrel and wedge assembly 100 according to some embodiments of the invention. A mandrel 105 and a wedge 110 are coupled together sharing an axle 155. In some embodiments, the mandrel 105 may have a larger diameter than the wedge 110. A slit-tube longeron 115 can be rolled up into a stowed state around the mandrel 105. In some embodiments, the mandrel 105 can be disk or cylinder-shaped and/or configured to have a curvature along two separate axes. In some embodiments, the mandrel 105 may include a partially cylinder-shaped portion 125 and a disk-shaped portion 120. The partially cylinder-shaped portion 125 may have a cylindrical axis perpendicular with the axle 155 and/or perpendicular with the axis of the disk-shaped portion 120. The partially cylinder-shaped portion 125 may include a flat portion.

In some embodiments, the mandrel 105 may include one or more openings or cavities within the mandrel 105 that allow the wedge to rotate at least partially within the opening or cavity. In some embodiments, the cylindrical-shaped portion 125 of the mandrel 105 may include one or more openings or cavities within the mandrel 105 that allow the wedge to rotate at least partially within the opening or cavity.

In some embodiments, the mandrel 105 may include a circular channel that may be used as a guide by the wedge 110 during rotation of the wedge 110 relative to the mandrel 105. In some embodiments, the wedge 110 may be rotated prior to the mandrel 105 being rotated. The wedge 110, for example, may rotate relative to the mandrel 105 causing the slit-tube longeron 115 to be flattened until a stop or pin is engaged whereupon both the wedge 110 and the mandrel rotate together to stow the slit-tube longeron.

The disk-shaped portion 120 may have a rolling curvature defined by an axis extending radially from the axle 155. The disk-shaped portion 120 may have a flat portion 130 that may provide a linear support for the slit-tube longeron 115 when in a deployed configuration. The flat portion 130 of the disk-shaped portion 120 may be located at a portion of the mandrel 105 where the disk-shaped portion 120 and the cylinder-shaped portion 125 intersect.

The flat portion 130 may be configured as part of the cylinder-shaped portion 125. The cylinder-shaped portion 125 can provide radial support for the slit-tube longeron 115 in the deployed state. In some embodiments, the cylinder-shaped portion 125 can have a diameter that is the same or larger than the diameter or the cross-section of the slit-tube longeron 115. The mandrel 105 can act as a support for the slit-tube longeron 115. In some embodiments, the load, heat, vibration, and/or electrical signals from the slit-tube longeron 115 are transmitted elsewhere.

In some embodiments, the slit-tube longeron 115 may be coupled with the cylinder-shaped portion 125 such as, for example, at or near the flat portion 130.

At least a portion of the wedge 110 may be positioned to interact with a slit side 116 of the slit-tube longeron 115. The wedge 110 can include two ramps positioned on each side of the mandrel 105. In some embodiments, the ramps can be crescent shaped and may have an height that increases along an outer crescent shaped perimeter of the wedge 110 from a first portion 111 to a 112 in a direct parallel with the axle 155. The mandrel 105 and the wedge 110 may be capable of both independent and/or concurrent rotation. A gap may be located between the cylinder-shaped portion 112 of the wedge 110 and the mandrel 105 that allows a portion of the slit-tube longeron 115 to wrap around a portion of the mandrel 105.

Upon rotating the wedge 110 in a first rotational direction, the increasing axial height of the ramps may interact with the slit side of the slit-tube longeron 115 and force a portion of the slit-tube to flatten (see FIGS. 7-14 discussed below). Upon flattening, the slit-tube longeron 115 may be biased to curve around the mandrel 105. The mandrel 105 can then be rotated in a first rotational direction to roll the flattened slit-tube longeron 115 in a roll. Rotating the mandrel 105 in a second rotational direction opposite to the first rotational direction allows the slit-tube longeron 115 to be unrolled and deployed. Rotating just the wedge 110 in the second rotational direction results in the interaction of the slit side of the slit-tube longeron 115 with a decreasing height of the wedge, allowing the slit-tube longeron to unflatten into a tube for full deployment.

FIG. 2 shows a fully deployed slit-tube longeron 115. As the wedge 110 is independently rotated in the first rotational direction (along an axis horizontal with the page), the slit-tube longeron 115 contacts progressively wider parts of the ramps on the wedge 110, as shown in FIGS. 3-5, until the slit-tube longeron 115 is flattened. FIG. 6 shows the slit-tube longeron 115 in a flattened state. In this position, the mandrel 105 (and possibly the wedge 110) can be rotated in the first rotational direction to roll and stow the slit-tube longeron 115. By reversing the order of the figures and the rotational steps, deployment of the slit-tube longeron 115 can be achieved.

Figure 7:
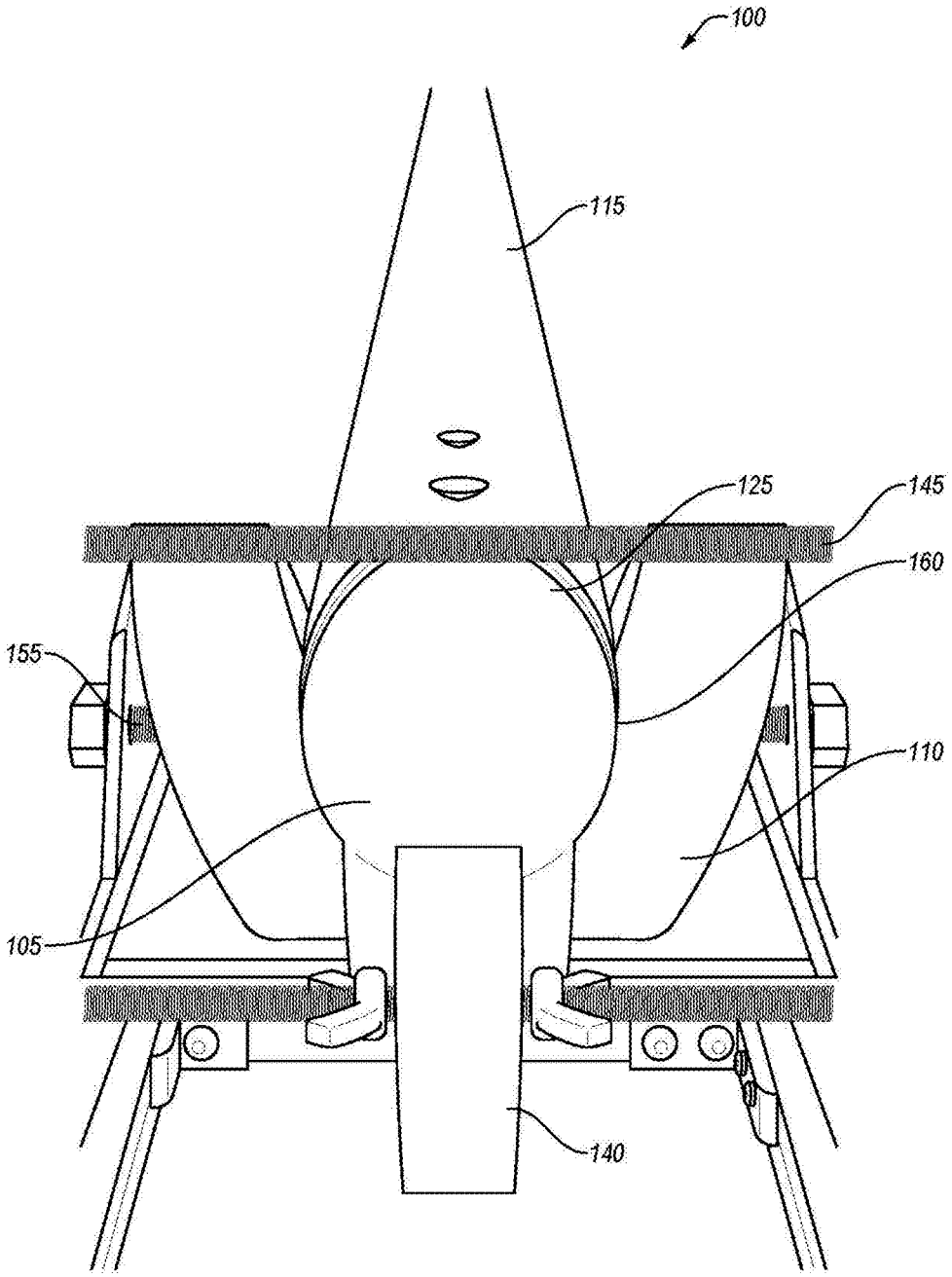
FIG. 7 is a rear view of a lock out feature of the assembly of FIG. 1 according to some embodiments of the invention.

As shown in FIG. 7, in a fully deployed state, a bottom side of slit-tube longeron is in contact with the mandrel 105. The wedge 110 is not in contact with the underside of the slit-tube longeron 115. Some embodiments include a lock out feature 160 on the wedge 110. Lock out feature 160 can be a cut out shape into a portion of the wedge 110, having a curvature similar to the cylinder-shaped portion 125 of the mandrel 105. The cut out shape of lock out feature 160 may optionally include angled channels configured to guide edges of the slit-tube longeron 115 into the curvature portion of lock out feature 160 as assembly 100 is rotated into a fully deployed state. While fully deployed, lock out feature 160 of the wedge 110 supports the slit-tube longeron 115 from the outside while the curvature defining the mandrel 105 supports the slit-tube longeron 115 from the inside, locking slit-tube longeron into its deployed and curled configuration.

Figure 8:
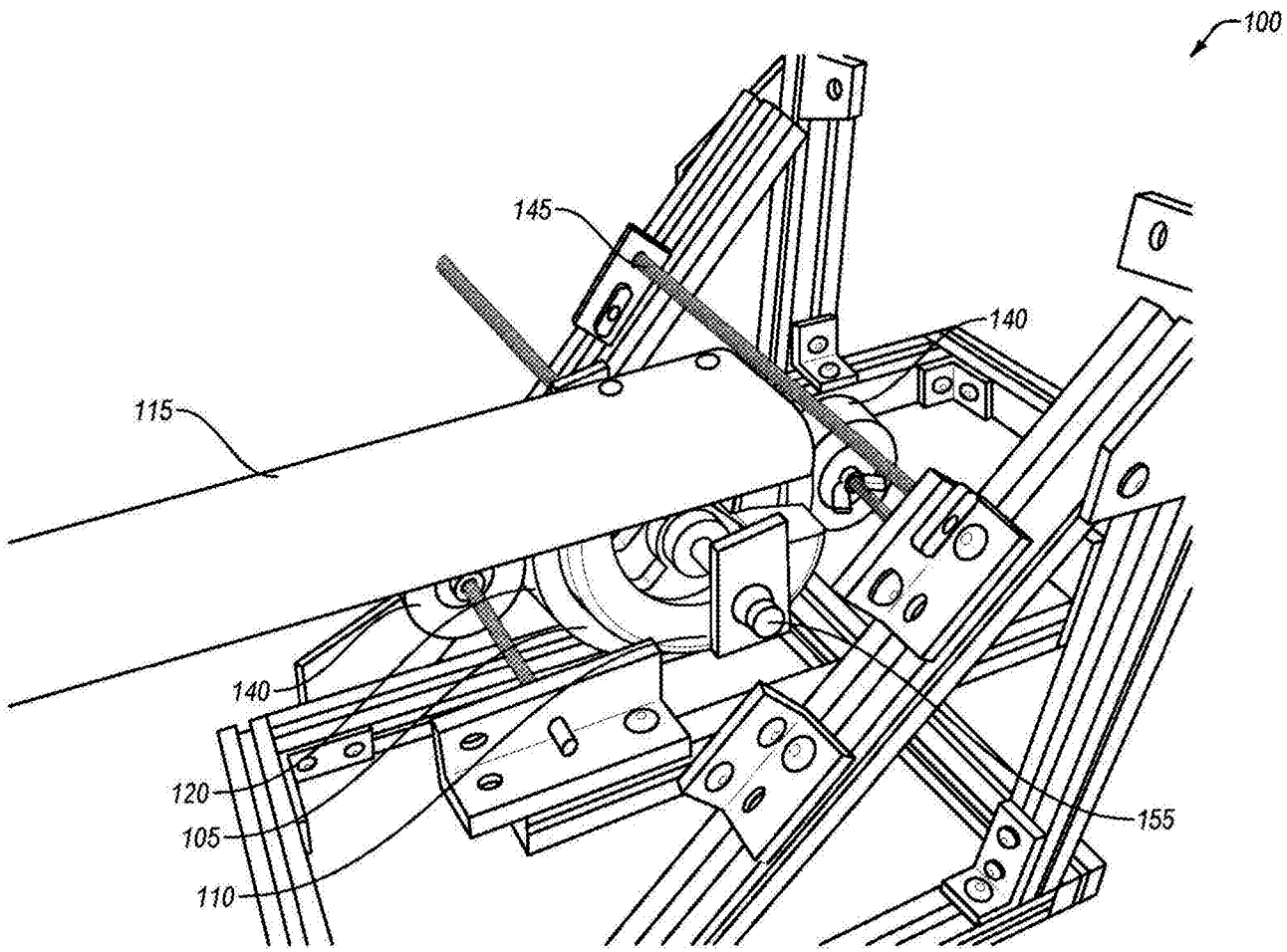
FIG. 8 is an isometric view of a mandrel and wedge assembly in a fully deployed state according to some embodiments according to some embodiments of the invention.
Figure 9:
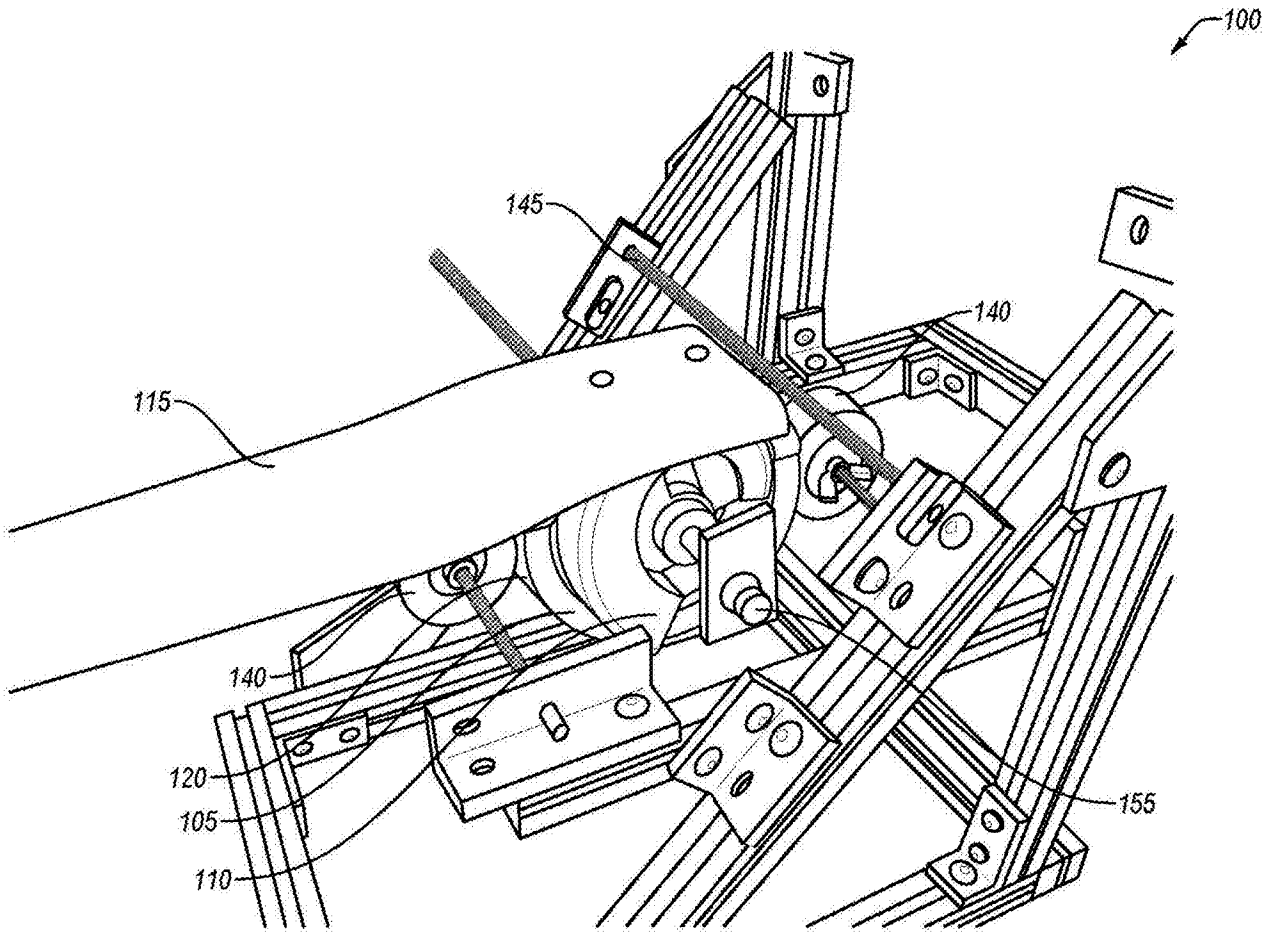
FIG. 9 is an isometric view of the assembly of FIG. 8 with the wedge slightly rotated according to some embodiments of the invention.
Figure 10:
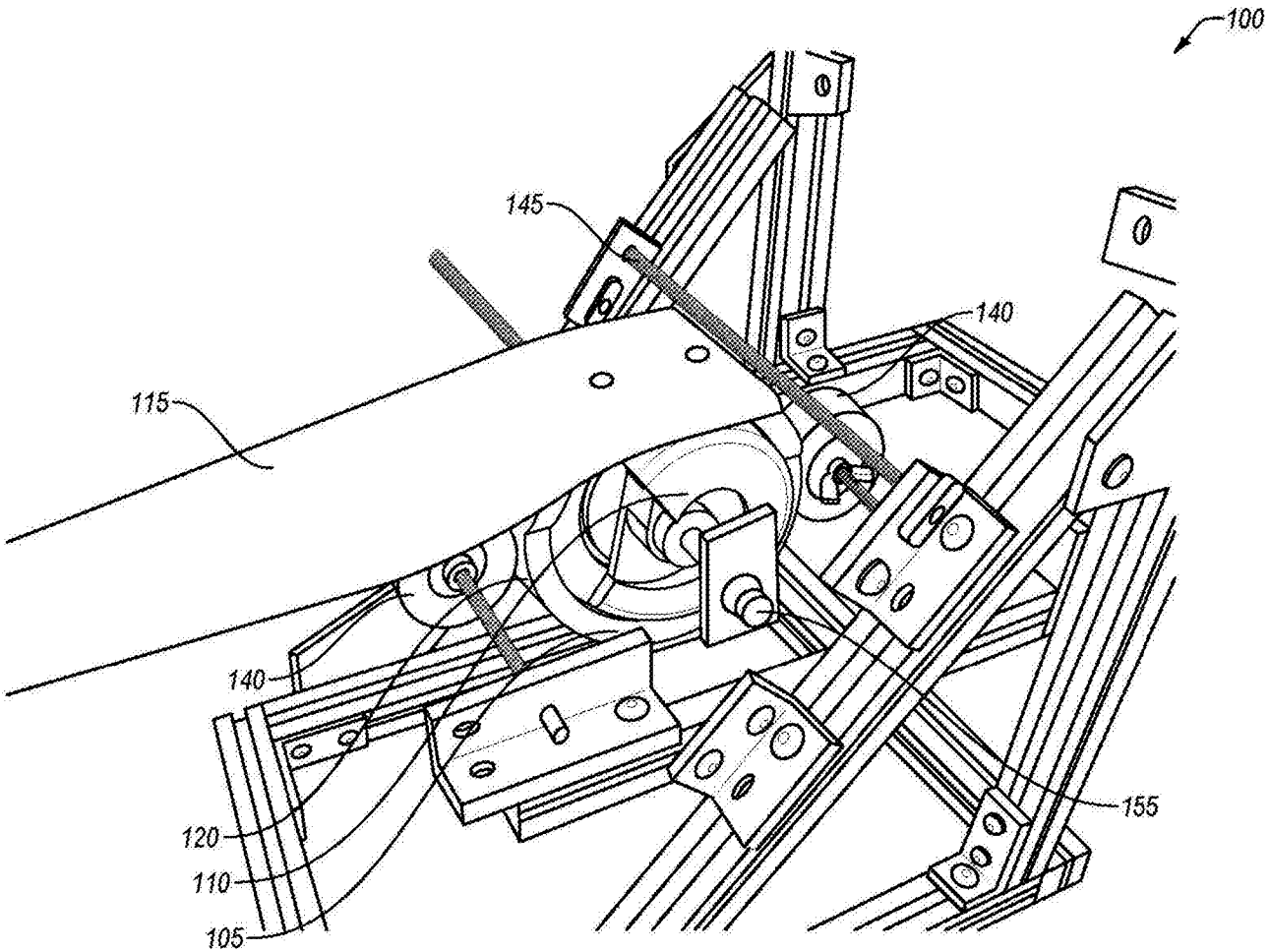
FIG. 10 is an isometric view of the assembly of FIG. 8 with the wedge significantly rotated according to some embodiments of the invention.

In FIG. 8, the wedge 110 is rotated to interact with the underside of the slit-tube longeron 115 and is beginning to flatten the slit-tube longeron 115. The ramp portion of the wedge 110 having a narrow axial height begins to open the slit of the slit-tube longeron and/or flatten the portion of the slit-tube longeron 115 in contact with the wedge 110 and/or the mandrel 105 while the other portion of the slit-tube longeron 115 remains curled. FIG. 9 shows the wedge 110 in a slightly more rotated position. A wider portion of the ramp is in contact with the underside of the slit-tube longeron 115 and the portion of the slit-tube longeron 115 in contact with the wedge 110 and/or the mandrel 105 is further opened and/or flattened. FIG. 10 shows the wedge 110 in a substantially rotated position. A heightened portion of the ramp of the wedge 110 is in contact with the underside of the slit-tube longeron 115 and the portion of the slit-tube longeron 115 in contact with wedge and the mandrel 105 is almost entirely opened and/or flattened.

Figure 11:
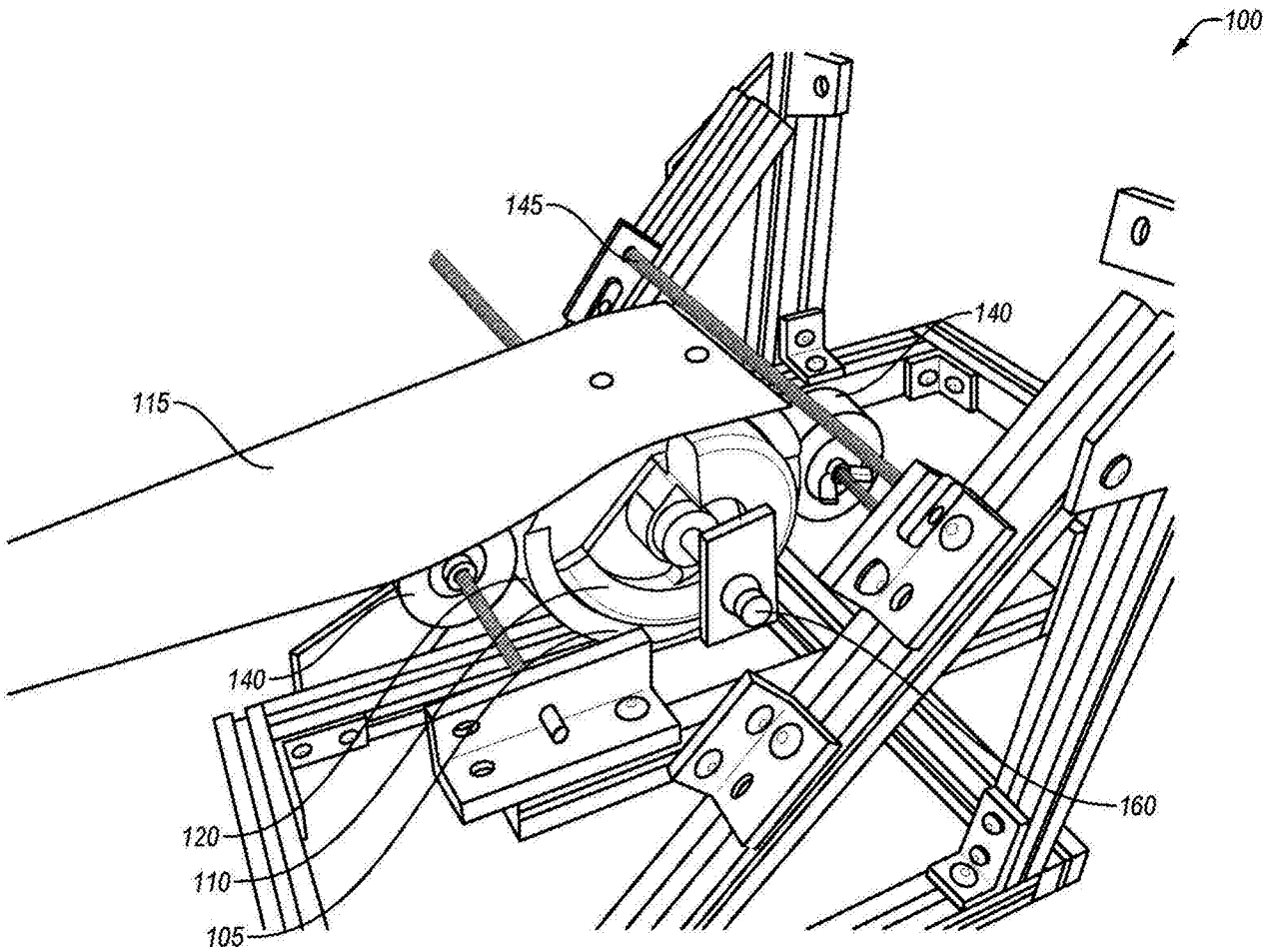
FIG. 11 is an isometric view of the assembly of FIG. 8 with the wedge fully rotated according to some embodiments of the invention.

FIG. 11 shows the wedge 110 fully rotated to a stowage ready position. The portion of the wedge 110 having the largest axial height is contacting the underside of the slit-tube longeron 115, resulting in the slit-tube longeron 115 being nearly fully flattened and the slit fully opened. The portion of the slit-tube longeron 115 that is not contacting the wedge 110 and/or the mandrel 105 remains in a curled position. Some embodiments may include one or more adjustable bars 145 that may help constrain the slit-tube longeron 115 during the stowage process to form and maintain a tight roll. As the slit-tube longeron 115 is flattened, it passes underneath adjustable bar 145 and is bias to roll around the mandrel 105.

Figure 12:
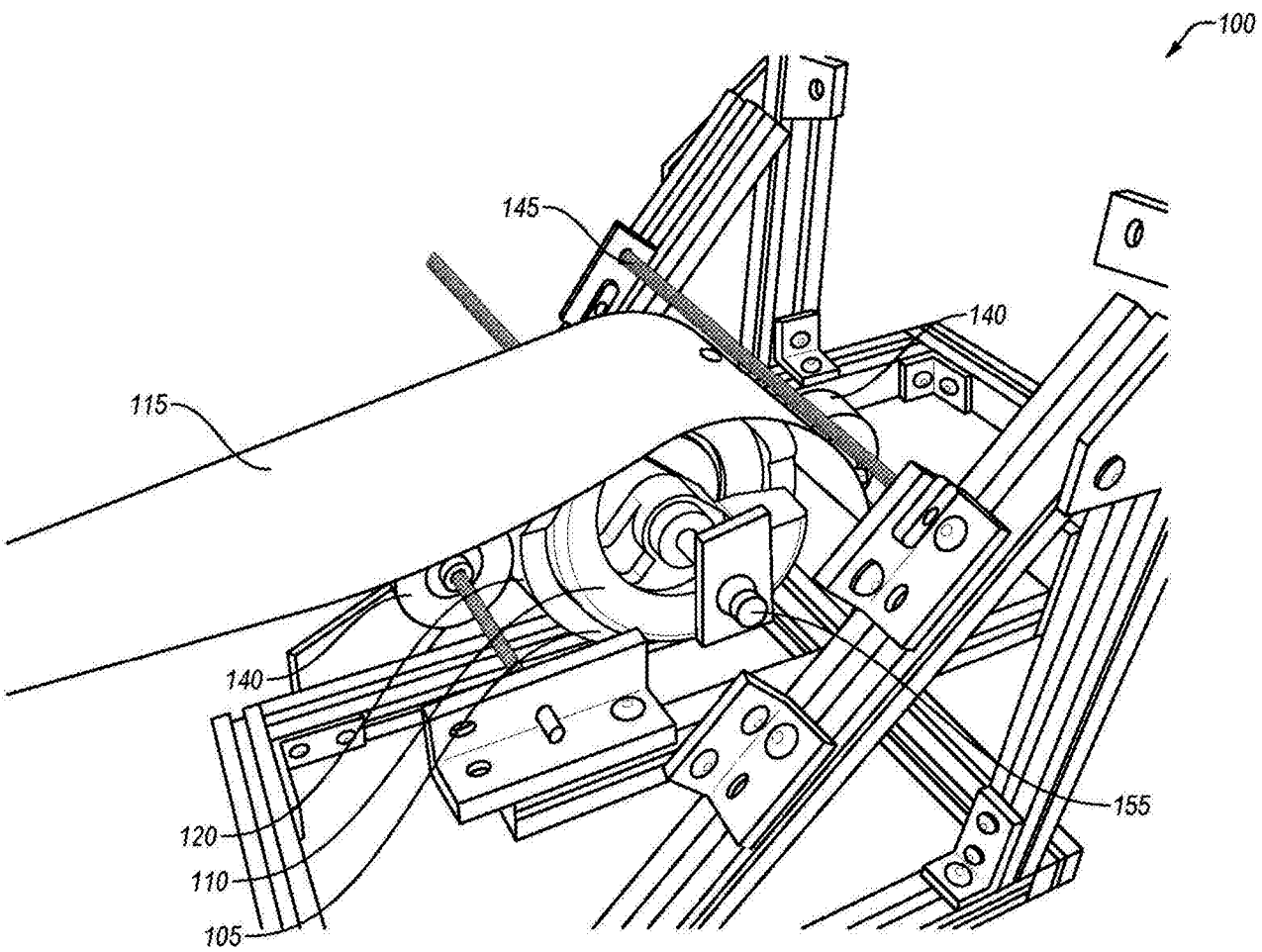
FIG. 12 is an isometric view of the assembly of FIG. 8 in a stowage process according to some embodiments of the invention.

FIG. 12 shows the wedge 110 and the mandrel 105 synchronously rotated to partially roll the slit-tube longeron 115 around the mandrel 105. Some embodiments may include one or more spring loaded rollers 140. Rollers 140 help constrain the slit-tube longeron 115 during the stowage process to form and maintain a tight roll. As the slit-tube longeron 115 is rolled, the portion of the slit-tube longeron 115 not in contact with the wedge 110 and/or the mandrel 105 remains curled.

Figure 13:
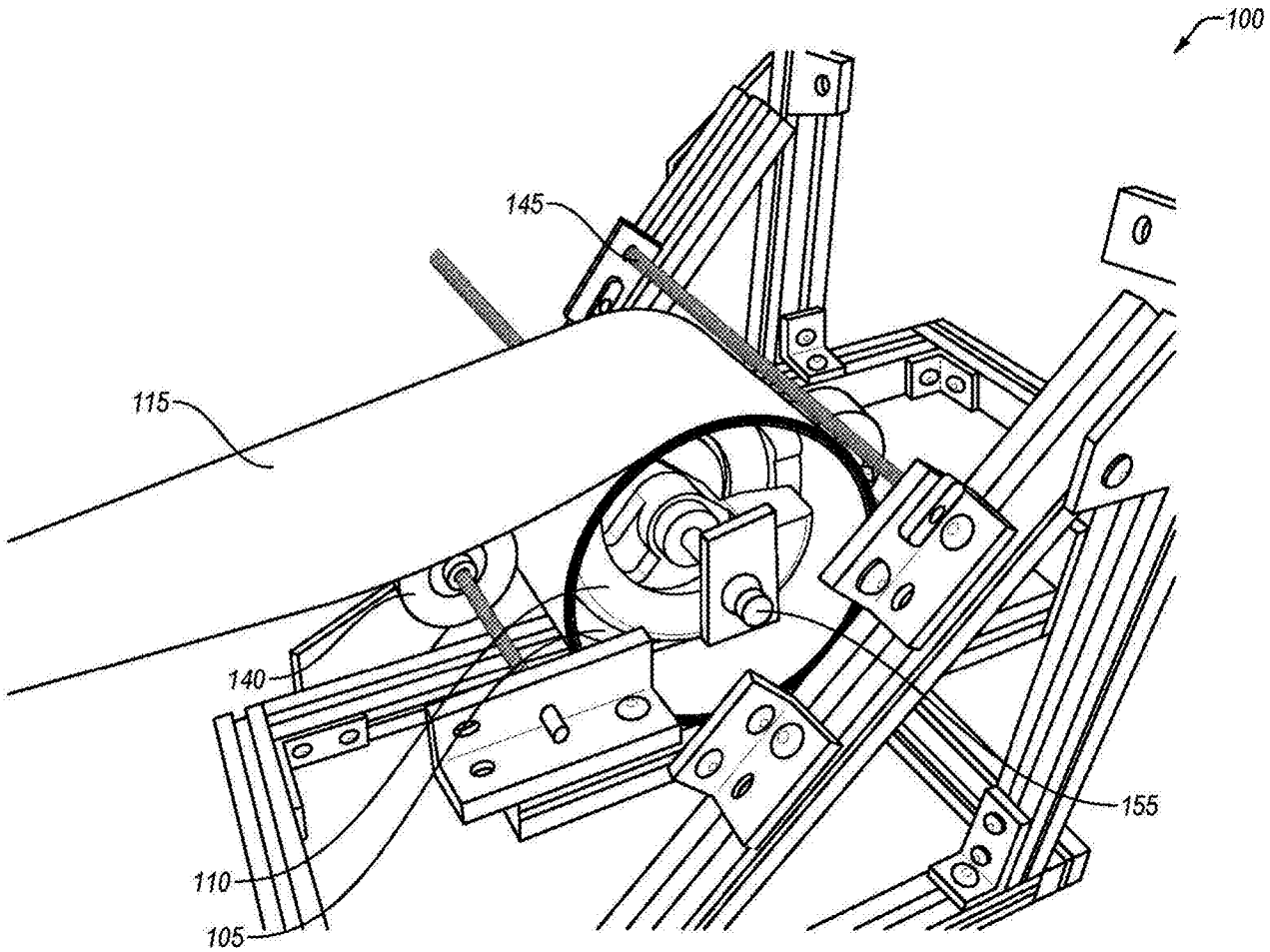
FIG. 13 is an isometric view of the assembly of FIG. 8 in a stowage process according to some embodiments of the invention.

FIG. 13 shows the wedge 110 and the mandrel 105 synchronously rotated and a roll of the slit-tube longeron 115 rolled around the mandrel 105. The tightness of the roll of the slit-tube longeron 115 is aided by engagement with adjustable bar 145 and rollers 140. The non-rolled portion of the slit-tube longeron 115 remains deployed in a curled state.

Figure 14:
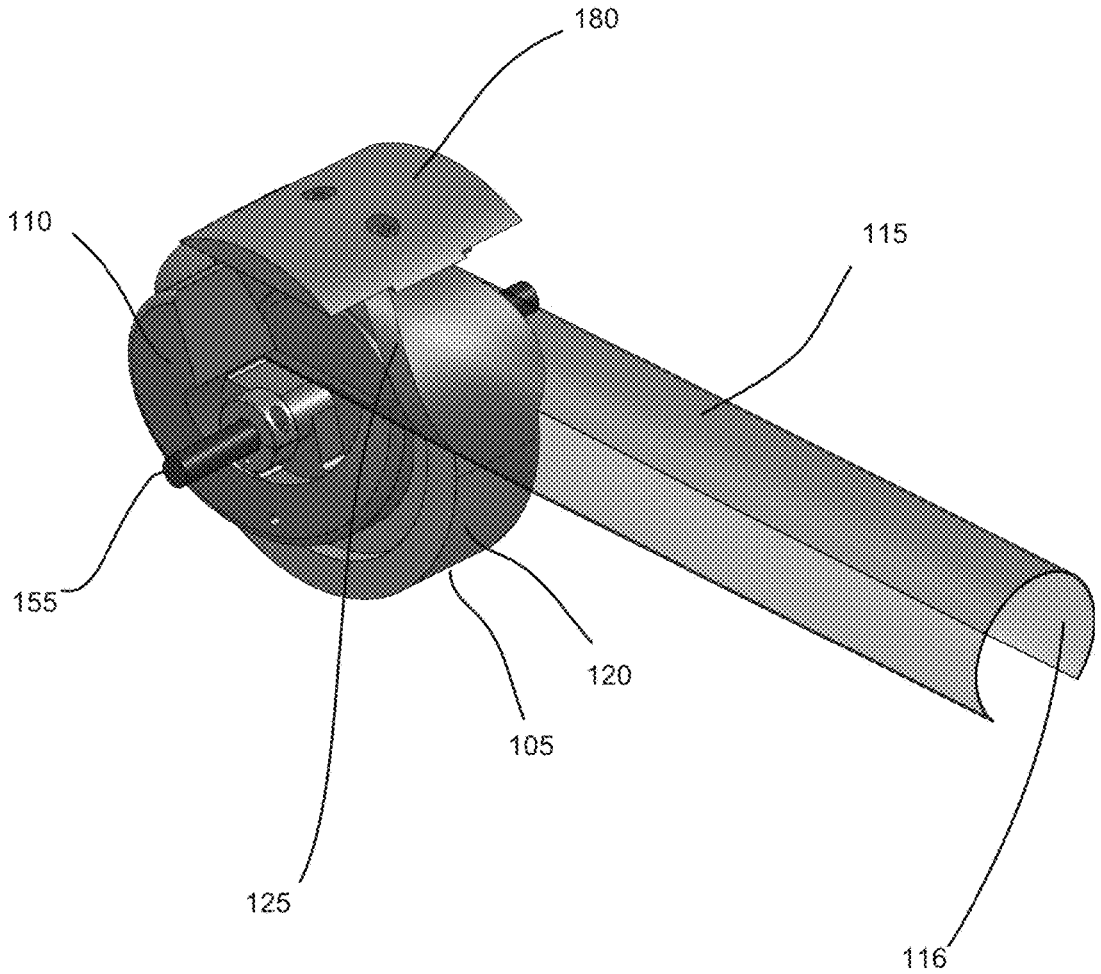
FIG. 14 is an isometric view of a mandrel and wedge assembly having a cap according to some embodiments of the invention.

FIG. 14 shows an assembly 100 including a cap 180. The cap 180 can be positioned above the slit-tube longeron 115 to valid a constant flat sport along the roll during the stowage process. The wedge 110 can be configured to lock flattened the slit-tube longeron 115 against the cap 180.

Embodiments of the present invention can include a motor for driving one or both of the mandrel 105 and the wedge 110. Other embodiments may optionally be partially or fully hand operated. Optionally, a locking mechanism may be included to that can be engaged to maintain synchronous rotation among the mandrel 105 and the wedge 110 while the slit-tube longeron 115 is being rolled or deployed. The locking mechanism can then be disengaged to allow independent rotation of the wedge 110 during the flattening or releasing of the slit-tube longeron 115.

The term "substantially" means within 5% or 10% of the value referred to or within manufacturing tolerances.

The foregoing is provided for purposes of illustrating, explaining, and describing embodiments of the present invention. Further modifications and adaptations to these embodiments will be apparent to those skilled in the art and may be made without departing from the scope or spirit of the invention. Different arrangements of the components depicted in the drawings or described above, as well as components and steps not shown or described are possible. Similarly, some features and subcombinations are useful and may be employed without reference to other features and subcombinations. Embodiments of the invention have been described for illustrative and not restrictive purposes, and alternative embodiments will become apparent to readers of this patent. Accordingly, the present invention is not limited to the embodiments described above or depicted in the drawings, and various embodiments and modifications can be made without departing from the scope of the claims below.

What is claimed is:

1. A slit-tube longeron system comprising:

a slit-tube longeron comprising:

a first end, a second end, a tubular shape that extend from the first end to the second in a deployed state, an internal radius of the tubular shape, and a slit that extends along the longitudinal length of the tubular shape from the first end to the second end, the slit-tube longeron;

a mandrel comprising:

a first portion having a disk like shape, a second portion having at least a partially cylindrical shape with a cylindrical diameter that is larger than the diameter of the tubular shape of the slit-tube longeron, the first end of the slit-tube longeron is coupled with the second portion of the mandrel, and an axis of rotation;

a wedge comprising:

an axis of rotation, and two at least partially crescent-shaped ramps disposed on opposites sides of the mandrel that increase in height in a direction parallel with the axis of rotation angularly around the axis of rotation from a first angular position on the wedge to a second angular position on the wedge; and an axle coupled and aligned with the mandrel and the wedge such that the mandrel and the wedge rotate independently around the axle.

2. The slit-tube longeron system according to claim 1, wherein at least a portion of the first end of the slit-tube longeron wraps around the second portion of the mandrel in the deployed configuration.

3. The slit-tube longeron system according to claim 1, wherein the second portion of the mandrel has at least one opening configured to allow the wedge to rotate at least partially within the opening.

4. The slit-tube longeron system according to claim 1, wherein the wedge is shaped to provide a gap between the mandrel and the wedge.

5. The slit-tube longeron system according to claim 1, further comprising a stowed state where the tubular shape of the slit-tube longeron is flattened by opening the slit-tube longeron along the slit and the slit-tube longeron is rolled around the mandrel.

6. The slit-tube longeron system according to claim 1, wherein the height of the wedge at the first angular position is greater than the height of the wedge at the second angular position.

7. The slit-tube longeron system according to claim 1, wherein when the wedge is rotated from a first angular position to a second angular position the two circular ramps open the slit of the slit-tube longeron.

8. The slit-tube longeron system according to claim 7, wherein after the wedge is rotated, the mandrel is rotated and pulls the slit-tube longeron around the mandrel.

9. The slit-tube longeron system according to claim 7, further comprising one or more spring loaded rollers that provide pressure on the slit-tube longeron as it is wrapped around the mandrel.

10. A slit-tube longeron stowage and deployment system, comprising:

a mandrel, in a stowed state, having a slit-tube longeron rolled on the mandrel and, in a deployed state, the slit-tube longeron rests on the mandrel; and a wedge shaped to force a portion of a cross section of the slit-tube longeron to flatten prior to rolling the slit-tube longeron on the mandrel.

11. The slit-tube longeron stowage and deployment system according to claim 10, wherein the wedge comprises two crescent-shaped ramps that have a height that increases from a first angular position to a second angular position along the crescent shape of the ramp.

12. The slit-tube longeron stowage and deployment system according to claim 10, wherein the mandrel comprises:

a first portion having a disk like shape; and a second portion having cylindrical shape with a cylindrical radius that is substantially similar to the radius of the tubular shape of a slit-tube longeron.

13. The slit-tube longeron stowage and deployment system according to claim 10, further comprising an axle coupled and aligned with the mandrel and the wedge such that the mandrel and the wedge rotate independently around the axle.

14. The slit-tube longeron stowage and deployment system according to claim 10, further comprising one or more spring loaded rollers that provide pressure on the slit-tube longeron as it is wrapped around the mandrel.

15. The slit-tube longeron stowage and deployment system according to claim 10, wherein the mandrel includes a flat portion.

16. A slit-tube longeron stowage and deployment system, comprising:

a mandrel having an axis of rotation, the mandrel having a portion with a first axis of curvature and a portion with a second axis of curvature and allows a slit-tube longeron to be rolled on the mandrel while in a stowed state and to rest upon the mandrel while in a deployed state, wherein the first axis of curvature is defined by the rotational axis of the mandrel, and wherein the second axis of curvature is defined by an axis parallel to an outer circumference of the mandrel;

a wedge on the same axis of rotation as the mandrel, wherein:

the wedge comprises crescent shaped and further has a height that increases along an outer perimeter as an arc of the crescent is traversed from a first end to a second end, the wedge is positioned under a slit side of the slit-tube, the wedge and mandrel can be independently rotated, as the wedge and mandrel are rotated in a first rotational direction the rotating wedge forces a cross section of the slit-tube to lay flat and the rotating mandrel rolls the flattened slit-tube into the stowed state, and as the wedge and mandrel are rotated in a second rotational direction the rotating wedge allows the cross section of the slit-tube to form a beam which is deployed by the rotating mandrel;

a first roller in contact with an anterior portion of the mandrel; and a second roller in contact with a posterior portion of the mandrel.

* * * * *